United States Patent [19]

Bertram

[11] 4,206,526

[45] Jun. 10, 1980

[54] HOSE WASHING MACHINE

[76] Inventor: Francis E. Bertram, Box 138A, Malone, Wis. 53049

[21] Appl. No.: 944,964

[22] Filed: Sep. 22, 1978

[51] Int. Cl.[2] ..... D06G 1/00; A46B 13/04

[52] U.S. Cl. ..... 15/40; 15/77

[58] Field of Search ..... 15/21 C, 40, 77, 88

[56] References Cited

U.S. PATENT DOCUMENTS

| | | | |
|---|---|---|---|
| 2,320,173 | 5/1943 | Cotton | 15/40 |
| 2,973,533 | 3/1961 | Franke, Jr. | 15/77 X |
| 3,213,472 | 10/1965 | Cocchiaraley et al. | 15/77 |
| 3,333,291 | 8/1967 | Hondzinski | 15/77 X |
| 3,561,032 | 2/1971 | Kasnyik et al. | 17/77 X |
| 3,946,454 | 3/1976 | Holm et al. | 15/77 |

FOREIGN PATENT DOCUMENTS

| | | | |
|---|---|---|---|
| 1711180 | 11/1934 | Switzerland | 15/40 |

*Primary Examiner*—Edward L. Roberts

*Attorney, Agent, or Firm*—Michael, Best & Friedrich

[57] ABSTRACT

A hose washing machine is provided including a frame and a pair of brushes supported by the frame in opposed relationship and for receiving a hose therebetween. Each of the brushes has a planar brush face engageable with the hose, and the brushes are supported for rotation about an axis transverse to the planar brush faces. The brush face of one of the brushes is positionable in opposed mating relation with the brush face of the other brush, and at least a portion of each of the brush faces engages the hose and moves in a direction transverse to the longitudinal axis of the hose. A first motor is provided for rotating one of the brushes in one rotational direction, and a second motor is provided for rotating the other of the brushes in an opposite rotational direction. The hose washing machine also includes apparatus for spraying detergent onto the hose including a nozzle and a pump means for supplying detergent to the nozzle, the pump means including a reciprocable pump piston and a rotatable cam engaging the pump piston for driving the piston, and the rotatable cam mounted on a rotatable shaft of one of the motors for rotation therewith.

18 Claims, 7 Drawing Figures

HOSE WASHING MACHINE

BACKGROUND OF THE INVENTION

1. Field of the Invention

The present invention relates to hose washing machines of the type for use in washing fire hoses and more particularly to hose washing machines which have power driven brushes for scrubbing hoses and means for applying cleaning fluid to the hoses as they are engaged by the power driven brushes. During the use of fire hoses, they are frequently dragged over the ground and are permitted to lie in dirty water or in muddy areas. Accordingly, it is necessary to clean the hoses before they can be rolled up for storage.

2. Description of the Prior Art

A hose washer for use in washing fire hose is illustrated in the McGraw et al U.S. Pat. No. 2,909,794 issued Oct. 27, 1959, and includes means for automatically feeding a length of fire hose between a plurality of rotating cylindrical brushes. The brushes shown in that patent rotate about longitudinal axes which are parallel and which are spaced apart on opposite sides of the path of travel of the hose as the hose travels through the hose washing machine. Those brushes are also supported such that the bristles of the brushes move in a direction along the longitudinal axis of the hose. One of the disadvantages of the McGraw et al hose washing machine is that fire hose of the type which is cleaned by that machine commonly includes closely-spaced ribs on its external surface and surrounding the hose in a direction transverse to the direction of movement of the brush bristles when the hose is being cleaned, and the brushes of the McGraw apparatus fail to effectively clean the grooves formed between the ribs of the hose. Furthermore, the brushes of the McGraw apparatus engage only the upper and lower surfaces of the flattened hose and fail to adequately clean the opposite edges of the hose. Another disadvantage of the McGraw et al structure lies in its complexity and in the resulting relatively high cost of manufacture. Due to the expense of such hose washing machines, they are impractical for small municipalities or volunteer fire departments.

Attention is also directed to the hose washing machine illustrated in the Whaley U.S. Pat. No. 2,784,432, issued Mar. 12, 1957. The structure shown in that patent has disadvantages similar to those of the structure of the McGraw et al patent in that the Whaley patent shows brushes which rotate such that the bristles move in the direction of the axis of the hose. Accordingly, the brushes will not effectively clean the grooves between the transverse ribs of the hose.

Attention is further directed to the Cotton U.S. Pat. No. 2,320,173, issued May 25, 1943 and the Sedgew U.S. Pat. No. 2,179,831, issued Nov. 14, 1939 and each showing a hose washing apparatus for use in washing fire hoses and the like and having a plurality of linearly reciprocating brushes.

Attention is also directed to the McLaughlin U.S. et al Pat. No. 3,471,885, issued Oct. 14, 1969; the Hamann U.S. Pat. No. 3,822,097, issued Aug. 6, 1974; and the Illing U.S. Pat. No. 1,166,163 issued Nov. 16, 1915.

SUMMARY OF THE INVENTION

The invention includes a hose washing machine having a frame and a pair of brushes supported by the frame and in opposed relationship and for receiving a hose therebetween. Each of the brushes has a planar brush face engageable with the hose, and the brushes are supported for rotation about an axis transverse to the planar brush faces. The brush face of one of the brushes is positionable in opposed mating relation with the brush face of the other brush with at least a portion of each of the brush faces engaging the hose and moving in a direction transverse to the longitudinal axis of the hose. Means are also provided for rotating one of the brushes in one rotational direction and for rotating the other of the brushes in an opposite rotational direction.

One of the principal features of the invention is the additional provision of means for spraying detergent onto the hose including a nozzle and a pump means for supplying detergent to the nozzle, the pump means including a reciprocable pump piston and a rotatable cam engaging the pump piston for driving the piston, the rotatable cam being driven by the means used to drive one of the brushes.

Another of the features of the invention is the provision of a housing positioned below the brushes and surrounding one of the brushes, the housing including a drain, and means in the housing for conveying fluid in the housing toward the drain.

Another of the features of the invention is the provision in the hose washing machine of brushes being rotatable around a vertical axis and one of the brushes being movable vertically toward and away from the other of the brushes to permit the hose to be placed between the brushes.

Another of the features of the invention is the provision of a first housing surrounding one of the brushes and including an upper wall having a periphery and side walls depending from the upper wall periphery and surrounding one of the brushes, and a second housing including a floor having a periphery and side walls extending upwardly from the floor periphery and surrounding the other of the brushes.

Another of the features of the invention is the provision of a motor supported above the upper wall, the motor including a driven shaft extending downwardly through the upper wall, one of the brushes being mounted on the driven shaft for rotation therewith, and a motor supported below the floor of the second housing, the second motor including a driven shaft extending upwardly through the floor, and wherein the other of the brushes is mounted on the second driven shaft for rotation therewith.

One of the advantages of the invention is that the hose washing machine is much less complicated than prior art structures. Accordingly, the hose washing machine is less expensive to manufacture and is also less complicated to operate. On the other hand, the machine of the invention is also more effective in cleaning hoses than the prior art structures, in part, because the construction of the apparatus of the invention provides for movement of the brush bristles across the hose in a direction transverse to the direction of movement of the hose to thereby improve the cleaning of the transverse grooves in the surface of the hose.

Other features and advantages of the invention will become known by reference to the following description, to the appended claims and to the drawings.

BRIEF DESCRIPTION OF THE DRAWINGS

FIG. 7 is an enlarged cross-section elevation view of a portion of the hose washing machine illustrated in FIG. 1.

Figures 1, 2, 3, 4:
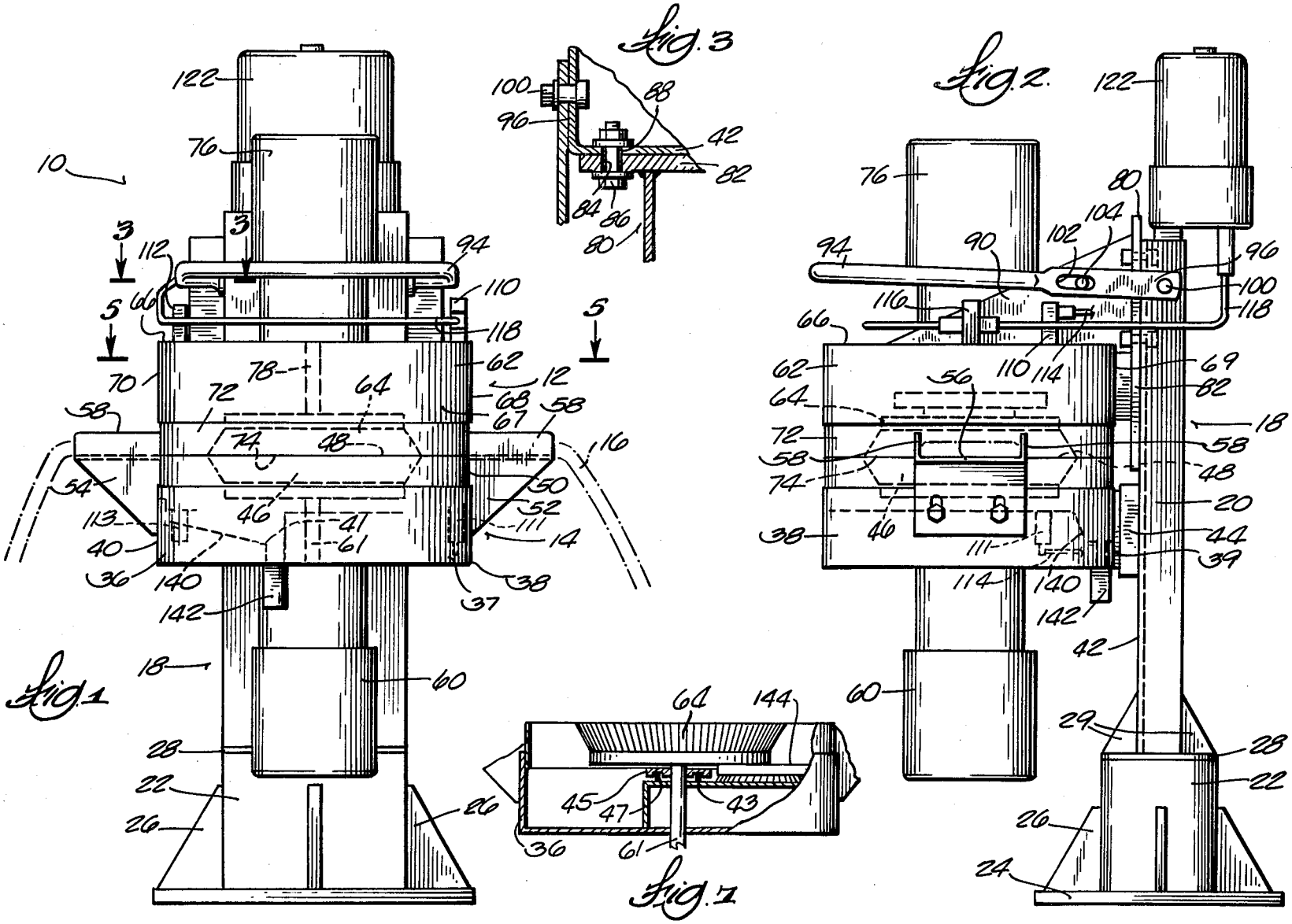
FIG. 1 is an elevation view of a hose washing machine embodying the present invention with a hose indicated in phantom passing through the hose washing machine.
FIG. 2 is a side elevation view of a hose washing machine shown in FIG. 1.
FIG. 3 is a cross-section view taken along line 3—3 in FIG. 1.
FIG. 4 is a plan view of the hose washing machine shown in FIG. 1.
Figure 4:
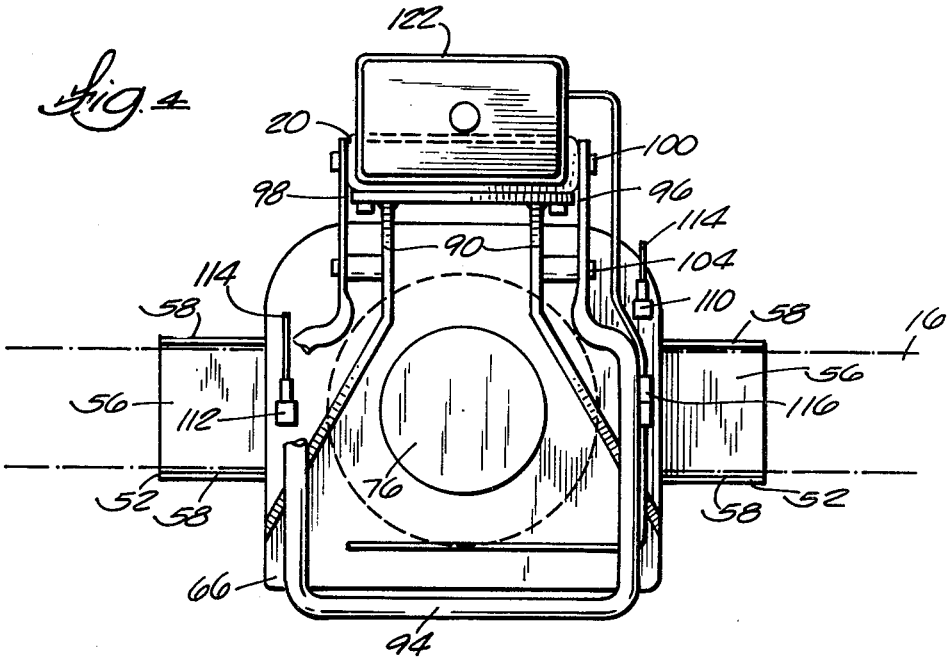

Before describing at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

Illustrated in FIGS. 1 and 2 is a hose washing machine 10 including a pair of vertically stacked brush assemblies 12 and 14 receiving a hose 16 therebetween, the hose 16 being illustrated in phantom. The hose 16 is intended to be fed from right to left as seen in FIG. 1, and is cleaned as it passes between the brush assemblies 12 and 14. The brush assemblies 12 and 14 are each supported by a frame assembly 18 including a rectangular vertical frame upright 20 supported by a frame base 22 and a supporting base plate 24. In the illustrated construction, the frame base 22 is supported by a plurality of triangular vertical supporting plates 26 welded or otherwise rigidly connected to the base plate 24 and to the frame base 22. The rectangular frame upright 20 is similarly supported by an upper plate 28 of the frame base 22 and by a plurality of vertical triangular plates 29 welded or otherwise rigidly joined to the upper plate 28 and to the frame upright 20. In an alternative embodiment of the invention, the brush assemblies 12 and 14 could also be suitably mounted on a wall or other vertical supporting surface.

The lower brush assembly 14 is comprised of a housing 36 having a generally rectangular configuration and including a plurality of vertically extending side walls 37, 38, 39, and 40 surrounding a housing floor 41. The side wall 39 is rigidly joined to a vertical plate 42 of the frame upright 20 by means of a support member 44. The housing 36 opens upwardly and contains a rotable brush 46 therein. The brush 46 is rotatably supported for rotation upon a vertical axis and includes a horizontally disposed upwardly facing brush face 48, the brush face 48 being generally parallel to and spaced above the plane defined by the upper edges of the sidewalls 37–40. In the specific construction illustrated, the housing 36 includes an upwardly extending skirt 50 which is made from a flexible material, such as rubber, and extends above or engages the lower edge of the upper brush assembly housing as explained below. If desired, the skirt 50 can be replaced with an outwardly flared flange (not shown) formed as an integral part of the side walls 37–40.

The lower brush assembly 14 also includes means for supporting a flattened hose 16 as it is fed through the hose washing machine 10 and for centering the hose with respect to the center of rotation of the brushes of the upper and lower brush assemblies 12 and 14. While various arrangements can be provided, in the illustrated construction alignment troughs 52 and 54 are attached to the upper edges of the sidewalls 38 and 40, respectively. The alignment troughs 52 and 54 include a generally horizontal bottom 56 functional to support the hose 16 as the hose is fed into the hose washing machine. The alignment troughs 52 and 54 also include upwardly extending side walls 58 for locating the hose 16.

Means are also provided for rotating the brush 46 about its vertical axis. While various such means can be provided, in the illustrated construction, the rotating means includes an electric gear motor 60 suspended below the housing 36 and supported thereby, and including an upwardly extending output shaft 61. The brush 46 is mounted on the output shaft 61 of the motor 60 for rotation therewith. In one embodiment of the invention the brush 46 is driven at a rate on the order of 50 to 100 rpm.

As illustrated in FIG. 7, means are also provided to prevent water from leaking around the shaft 61. In the illustrated construction, such means include an annular ring 43 welded to the floor 41 and surrounding the shaft 61, and a circular disc 45 secured to the brush 46 and having an annular groove 47 in its lower surface. The annular ring 43 is received in the groove 47 to provide a labyrinthine path preventing water from leaking from the housing 36.

The upper brush assembly 12 has a construction similar to that of the brush assembly 14 and is supported above and is movable toward and away from the brush assembly 14. The upper brush assembly 12 includes a generally rectangular housing 62 surrounding and rotatably supporting a rotatable brush 64. The housing 62 includes an upper rectangular horizontal planar top wall 66 and a plurality of sidewalls 67, 68, 69 and 70 extending downwardly from the periphery of the top wall 66. A flexible resilient skirt 72, constructed from rubber, plastic or the like, surrounds and extends downwardly from the lower edges of the sidewalls 67–70. The lower edge of the skirt 72 engages or overlaps the upper edge of the skirt 50 to prevent escape of water from between the two skirts 50 and 72. The rotatable brush 64 is rotatably supported by the upper planar wall 66 of the housing 62 and extends downwardly therefrom. The brush includes a planar horizontal brush face 74 positionable in mating engagement with the planar brush face 48 of the brush 46. The planar brush face 74 is also positioned below the lower edges of the sidewalls 67–70 and in generally co-planar alignment with the lower edge of the flexible resilient skirt 72.

Means are also provided for rotating the brush 64 about its vertical axis and in a rotational direction opposite to the rotational direction of the brush 46. In the illustrated construction, the brush rotating means can comprise an electric gear motor 76 supported in vertical orientation and positioned on the upper planar wall 66 of the housing 62. The motor 76 includes a downwardly extending rotor shaft 78 and the brush 64 is mounted on the rotor shaft 78 for rotation therewith.

Means are also provided for supporting the upper brush assembly 12 for vertical movement toward and away from the lower brush assembly 14 to thereby permit upward movement of the upper brush assembly 12 away from the lower assembly 14 to permit the hose 16 to be fed into the hose washing machine, i.e. placed between the planar brush faces 48 and 74 of the brushes 46 and 64, respectively. The means for supporting the upper brush assembly 12 includes a bracket member 80 supported against the vertical plate 42 of the frame upright 20. The bracket member 80 includes a backing plate 82 (FIG. 3) positioned against the plate 42. The backing plate 82 includes a pair of parallel spaced vertical slots 84 (FIG. 3) and is held against the plate 42 by bolts 86 which extend through the slots 84 and which are respectively received in bores 88 in the plate 42. The vertical slots 84 permit vertical sliding movement of the plate 82 against the face of the plate 42 of the frame 20. The bracket member 80 also includes a pair of triangular vertical support plates 90 welded or otherwise rigidly joined to the plate 82 and also welded or otherwise rigidly joined to the upper plate 66 of the housing 62.

In the illustrated construction, the means for supporting the upper brush assembly 12 for vertical movement also includes a pivotable U-shaped handle 94 having opposite ends 96 and 98 (FIGS. 2 and 4) pivotally connected to the opposite sides of the upright frame member 20 by pivot pins 100. The U-shaped handle 94 also includes slots 102 spaced from the pivot pins 100 and intended to receive pins 104 extending outwardly from the vertical support plates 90.

In operation, upward movement of the bite portion of the handle 94 will result in upward movement of the pins 104 and upward vertical movement of the support plates 90 and the upper brush assembly 12.

The upper and lower brush assemblies 12 and 14 provide a container surrounding the brushes 46 and 64 and also provide a washing chamber for receiving the hose 16. To facilitate cleaning of the hose 16, means are also provided for injecting the water into the washing chamber formed by the upper and lower brush assembly housings 36 and 63. While various arrangements can be provided, in the illustrated construction which means are provided by water injection nozzles 110, 111, 112 and 113. The water injection nozzle 110 extending downwardly from the upper horizontal wall 66 and the water injection nozzle 111 extending upwardly from the floor 41 are intended to spray water onto the hose 16 as the hose enters the washing chamber. The injection nozzle 112 extending downwardly from the upper horizontal wall 66 and the water injection nozzle 113 extending upwardly from the floor 41 function to spray water on the hose 16 as the hose 16 exits the washing chamber, to thereby rinse the hose. The nozzles are suitably connected to a source of water through conduits 114.

Means are also provided for injecting a cleaning agent such as soap or liquid detergent into the washing chamber formed by the housings 62 and 36. While various arrangements can be provided, in the illustrated construction, the cleaning agent injection means includes a nozzle 116 supported by and extending through the upper wall of the housing 62, a conduit 118 connected to the nozzle 116, and pump means 120 for forcing detergent through the conduit 118. In the illustrated construction liquid detergent is held in a reservoir 122. The conduit 118 forms a continuous path from the detergent reservoir 122 to the nozzle 116 and returning to the detergent reservoir 122. The pump means 120 comprises a piston cylinder pump which is connected in the conduit 118 for causing continuous flow of the liquid detergent from the reservoir through the conduit 118 and back to the reservoir 122.

A four-lobed cam 124 (FIG. 5) is mounted on the rotor shaft 78 of the gear motor 76, and the piston 126 of the pump means 120 includes an end supporting a cam follower 128. The cam follower 128 engages the cam surface of the four-lobed cam 124 such that rotation of the four-lobed cam 124 during operation of the motor 76 causes reciprocal movement of the piston 126 to thereby cause pumping of detergent through the continuous conduit 118 in the manner shown schematically in FIG. 6. The cam follower 128 is maintained in engagement with the surface of the four-lobed cam 124 by a coil spring 127 disposed in cylinder 125 and between the end wall of the cylinder 125 and the end of piston 126.

As also shown therein, the pump means 120 also includes a pair of check valves 130 and 132 provided in the continuous conduit 118 and on opposite sides of the cylinder 125 of the piston and cylinder pump to maintain fluid flow in one direction through the pump and through the continuous conduit 118. Since the cam 124 is provided with four lobes, each revolution of the motor shaft 78 functions to cause four pumping strokes of the piston 126.

Figure 6:
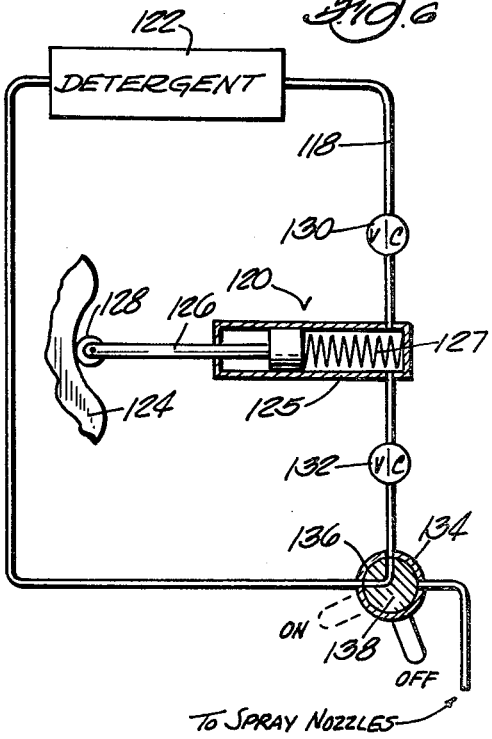
FIG. 6 is a schematic view of a detergent flow circuit and detergent pump means of the hose washing machine shown in FIG. 1.

A valve means 134 is also provided for selectively connecting the continuous conduit 118 to the liquid detergent injection nozzle 116 to provide flow of detergent into the washing chamber formed by the housings 36 and 64. Referring to FIG. 6, the valve means includes a valve body 136 housing an oscillatable valve member 138, the valve member 138 being movable from the position shown in FIG. 6 wherein the continuous fluid flow is provided through the conduit 118 causing flow of detergent back to the detergent reservoir 122 to a second position wherein the conduit 118 is in communication with the nozzle 116.

In operation of the hose washing machine of the invention, the handle 94 can be raised to thereby raise the upper brush assembly 12 to permit a hose 16 to be placed between the planar brush faces 48 and 74 of the brushes 46 and 64, respectively. By lowering the handle 94, the hose 16 is then engaged between the brush faces. Actuation of the motors 60 and 76 causes the brushes to rotate in opposite rotational directions. The hose can then be manually drawn through the hose washing machine from right to left as seen in FIG. 1. Water and detergent are sprayed onto the hose by nozzles 110 and 116, respectively, as the hose enters the hose washing machine and rinsing water is sprayed onto the hose by the nozzle 112 as the hose exits the hose washing machine. It should be noted that the detergent nozzle 116 is positioned downstream of the water nozzle 110 with respect to the direction of rotation of the brush 64 so that water is sprayed onto the brush before the detergent is applied. The waste water and dirt from the hose drain into the housing 36 of the lower brush assembly 14 and can be conveyed through a trough portion 140 formed integrally in the bottom wall 41 of the housing 36 and through an outlet 142 to a suitable drain. To facilitate movement of the waste water and dirt to drain 142, a scraper or brush 144 can be actuated to the lower surface of the brush 46. The scraper or brush is intended to project radially outwardly from the axis of rotation of the brush and beyond the periphery of the brush, and also to engage the upper surface of the floor 41 of the housing 36. Accordingly, as the brush 144 rotates, it will sweep the waste water and dirt toward the trough portion 140 and drain 142.

Figure 5:
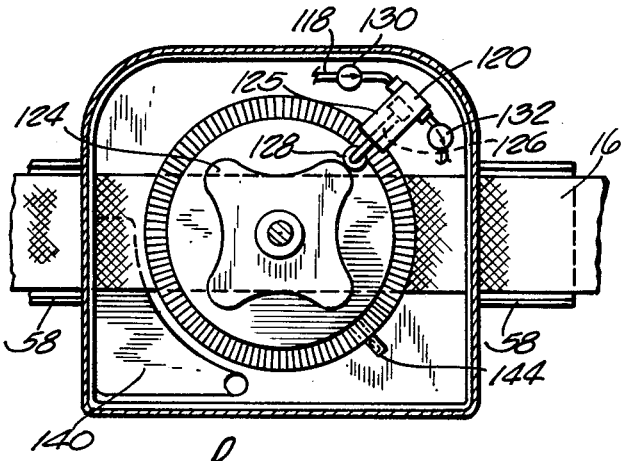
FIG. 5 is a cross-section view taken along line 5—5 in FIG. 1.

One of the advantages of the hose washing machine of the invention is that the bristles of the brushes 46 and 64 will move laterally with respect to the hose as the hose is pulled through the hose washing machine and will accordingly function to clean the grooves in the hose since the bristles will be moving parallel to the ribs of the hose. Furthermore, as shown in FIGS. 2, 4 and 5, the brushes 46 and 64 have a diameter greater than the width of the hose 16, and the edges of the brushes will surround and engage the edges of the hose 16 as it is pulled through the hose washing machine, thereby cleaning the sides.

Another of the advantages of the hose washing machine of the invention is that it has a simplified construction even though it functions better than prior art machines. Since the machine of the invention is simplified it is less complicated to manufacture and consequently less expensive. Accordingly, the machines of the invention are available to smaller fire departments in small municipalities or volunteer units.

Various of the features of the invention are set forth in the following claims.

I claim:

1. A hose washing machine comprising:

a frame, a pair of brushes supported by said frame and in opposed relationship and for receiving a hose therebetween as the hose is moved longitudinally therethrough, each of said brushes having a planar brush face engageable with the hose, said brushes being supported for rotation about an axis transverse to said planar brush faces and the brush face of one of said brushes being positionable in opposed mating relation with the brush face of the other brush, and at least a portion of each of said brush faces engaging the hose and moving in a direction transverse to the direction of movement of the hose, means for rotating one of said brushes in one rotational direction, means for rotating the other of said brushes in an opposite rotational direction, and means for moving at least one of said brushes away from the other of said brushes to facilitate placement of a hose therebetween and for moving said at least one of said brushes toward the other of said brushes to cause engagement of said brushes with said hose.

2. The hose washing machine set forth in claim 1 and further including a housing positioned below said brushes, said housing including a drain, and means in said housing for conveying fluid in said housing toward said drain.

3. The hose washing machine as set forth in claim 1 and further including a first housing surrounding one of said brushes and including an upper horizontal wall having a periphery and side walls depending from said upper wall periphery and surrounding one of said brushes, and a second housing including a floor having a periphery and side walls extending upwardly from said floor periphery and surrounding the other of said brushes.

4. The hose washing machine as set forth in claim 3 wherein said floor of said second housing includes a drain, and further including means for supplying hose washing fluid to said second housing and means in said second housing for conveying said fluid in said housing toward said drain, said conveying means including a member attached to said other of said brushes and rotatable with said other of said brushes.

5. The hose washing machine as set forth in claim 3 wherein said means for rotating said one of said brushes is a motor supported above said upper horizontal wall, said motor including a driven shaft extending downwardly through said upper horizontal wall, and wherein said one of said brushes is mounted on said driven shaft for rotation therewith.

6. The hose washing machine as set forth in claim 5 wherein said means for driving the other of said brushes includes a motor supported below the floor of said second housing, said second motor including a driven shaft extending upwardly through said second housing floor, and wherein said other of said brushes is mounted on said second driven shaft for rotation therewith.

7. A hose washing machine as set forth in claim 1 wherein the hose includes an upper surface, a lower surface and opposed lateral edges, and wherein said brushes engage said opposed lateral edges of said hose for washing the lateral edges of the hose.

8. A hose washing machine comprising:

a frame, a first housing supported by said frame and including an upper wall having a periphery and side walls depending from said upper wall periphery, a first rotatable brush supported in said first housing and having a planar brush face, said brush being supported for rotation about an axis transverse to said brush face and transverse to and extending through said upper wall, a second housing supported by said frame below said first housing, said second housing including a floor having a periphery and side walls extending upwardly from said floor periphery, a second rotatable brush supported in said second housing, said second brush including a planar brush face positionable in opposed parallel closely adjacent relation to said brush face of said first brush, said second brush being supported for rotation about an axis transverse to said brush face, a first motor connected to said first brush for rotating said first brush in a first rotational direction, a second brush motor connected to said second brush for rotating said second brush in a direction opposite said first rotational direction, and means for moving at least one of said brushes away from the other of said brushes to facilitate placement of a hose therebetween and for moving said at least one of said brushes toward the other of said brushes to cause engagement of said brushes with said hose.

9. A hose washing machine as set forth in claim 8 wherein said floor of said second housing includes a drain, and further including means for supplying hose washing fluid to said second housing and means in said second housing for conveying said fluid in said housing toward said drain said conveying means including a member attached to said second rotatable brush and rotatable therewith.

10. The hose washing machine as set forth in claim 8 wherein said first motor is supported above said upper wall, said motor including a driven shaft extending downwardly through said upper wall, and wherein said first rotatable brush is mounted on said driven shaft for rotation therewith.

11. The hose washing machine as set forth in claim 10 wherein said second motor is supported below said floor of said second housing, said second motor including a driven shaft extending upwardly through said floor, and wherein said second rotatable brush is mounted on said second driven shaft for rotation therewith.

12. A hose washing machine as set forth in claim 8 and wherein the hose includes an upper surface, a lower surface and opposed lateral edges, and wherein said brushes engage said opposed lateral edges of said hose for washing the lateral edges of the hose.

13. A hose washing machine comprising:

a frame, a first housing supported by said frame and including an upper wall having a periphery and side walls depending from said upper wall periphery, a first rotatable brush supported in said first housing and having a planar brush face, said brush being supported for rotation about an axis transverse to said brush face and transverse to and extending through said upper wall, a second housing supported by said frame below said first housing, said second housing including a floor having a periphery and side walls extending upwardly from said floor periphery, a second rotatable brush supported in said second housing, said second brush including a planar brush face positionable in opposed parallel closely adjacent relation to said brush face of said first brush, said second brush being supported for rotation about an axis transverse to said brush face, a first motor supported by said upper wall, said motor including a rotatably driven shaft extending downwardly through said upper wall, and wherein said first rotatable brush is mounted on said driven shaft for rotation therewith, a second motor supported by said floor and below said floor, said second motor including a rotatably driven shaft extending upwardly through said floor, and said second brush being mounted on said second driven brush for rotation therewith and in a rotational direction opposite the rotational direction of said first brush, means for spraying cleaning fluid into said housings including a nozzle connected to one of said housings for spraying cleaning fluid into said housings, a pump means connected to said nozzle for supplying cleaning fluid to said nozzle, and means for moving at least one of said brushes away from the other of said brushes to facilitate placement of a hose therebetween and for moving said at least one of said brushes toward the other of said brushes to cause engagement of said brushes with said hose.

14. A hose washing machine comprising a frame, a pair of brushes supported by said frame and in opposed relationship and for receiving a hose therebetween as the hose is moved longitudinally therethrough, each of said brushes having a planar brush face engageable with the hose, said brushes being supported for rotation about an axis transverse to said planar brush faces and the brush face of one of said brushes being positionable in opposed mating relation with the brush face of the other brush, and at least a portion of each of said brush faces engaging the hose and moving in a direction transverse to the direction of movement of the hose, means for rotating one of said brushes in one rotational direction, said means for rotating one of said brushes including a motor having a rotatable shaft, said one of said brushes connected to said shaft for rotation therewith, means for rotating the other of said brushes in an opposite rotational direction, and means for spraying detergent onto said hose including a nozzle and a pump means for supplying detergent to said nozzle, said pump means including a reciprocable pump piston and a rotatable cam engaging said pump piston for driving said piston, said rotatable cam mounted on said rotatable shaft for rotation therewith.

15. The hose washing machine set forth in claim 14 and further including valve means connected between said pump means and said nozzle and for selectively connecting said pump means to said nozzle.

16. A hose washing machine comprising:

a frame, a first housing supported by said frame and including an upper wall having a periphery and side walls depending from said upper wall periphery, a first rotatable brush supported in said first housing and having a planar brush face, said brush being supported for rotation about an axis transverse to said brush face and transverse to and extending through said upper wall, a second housing supported by said frame below said first housing, said second housing including a floor having a periphery and side walls extending upwardly from said floor periphery, a second rotatable brush supported in said second housing, said second brush including a planar brush face positionable in opposed parallel closely adjacent relation to said brush face of said first brush, said second brush being supported for rotation about an axis transverse to said brush face, a first motor connected to said first brush for rotating said first brush in a first rotational direction, a second brush motor connected to said second brush for rotating said second brush in a direction opposite said first rotational direction, and means for spraying detergent into one of said housings including a nozzle and a pump means for supplying detergent to said nozzle, said pump means including a reciprocable pump piston and a rotatable cam engaging said pump piston for driving said piston, said rotatable cam driven by one of said motors.

17. The hose washing machine set forth in claim 16 and further including valve means connected between said pump means and said nozzle and for selectively connecting said pump means to said nozzle.

18. The hose washing machine set forth in claim 16 wherein said brushes are rotatable around a vertical axis and wherein one of said brushes is movable vertically toward and away from the other of said brushes to permit the hose to be placed between the brushes.

* * * * *